US007471246B2

(12) United States Patent
Soler Castany et al.

(10) Patent No.: US 7,471,246 B2
(45) Date of Patent: Dec. 30, 2008

(54) ANTENNA WITH ONE OR MORE HOLES

(75) Inventors: Jordi Soler Castany, San Cugat del Valles (ES); Carles Puente Baliarda, San Cugat del Valles (ES)

(73) Assignee: Fractus, S.A., Barcelona (ES)

( * ) Notice: Subject to any disclaimer, the term of this patent is extended or adjusted under 35 U.S.C. 154(b) by 0 days.

(21) Appl. No.: 11/036,509

(22) Filed: Jan. 12, 2005

(65) Prior Publication Data

US 2005/0156803 A1 Jul. 21, 2005

(51) Int. Cl.
*H01Q 1/38* (2006.01)
*H01Q 13/12* (2006.01)
*H01Q 13/10* (2006.01)

(52) U.S. Cl. ..... 343/700 MS; 343/769; 343/770

(58) Field of Classification Search ..... 343/700 MS, 343/767, 769, 770, 793, 810
See application file for complete search history.

(56) References Cited

U.S. PATENT DOCUMENTS

| | | | | |
|---|---|---|---|---|
| 5,210,542 | A | 5/1993 | Pett et al. | |
| 5,606,733 | A | 2/1997 | Kanayama | |
| 5,872,546 | A | 2/1999 | Ihara et al. | |
| 6,097,345 | A * | 8/2000 | Walton | 343/769 |
| 6,140,975 | A | 10/2000 | Cohen | |
| 6,195,048 | B1 | 2/2001 | Chiba et al. | |
| 6,278,410 | B1 * | 8/2001 | Soliman et al. | 343/769 |
| 6,281,846 | B1 | 8/2001 | Puente Baliarda et al. | |
| 6,366,260 | B1 | 4/2002 | Carrender | |
| 6,407,710 | B2 | 6/2002 | Keilen | |
| 6,650,301 | B1 * | 11/2003 | Zimmerman | 343/803 |
| 6,806,834 | B2 | 10/2004 | Yoon | |
| 6,809,692 | B2 * | 10/2004 | Puente Baliarda et al. | 343/713 |
| 7,123,208 | B2 * | 10/2006 | Puente Baliarda et al. | 343/800 |
| 2002/0175879 | A1 | 11/2002 | Sabet | |
| 2002/0177416 | A1 | 11/2002 | Boyle | |
| 2003/0193438 | A1 | 10/2003 | Yoon | |

FOREIGN PATENT DOCUMENTS

| | | | |
|---|---|---|---|
| CA | 2416437 | A1 | 1/2002 |
| GB | 2289163 | A1 | 11/1995 |
| GB | 2387486 | A | 10/2003 |

(Continued)

OTHER PUBLICATIONS

Tung, Integrated rectangular spiral monopole antenna for 2.4/5.2 GHz dual-band operation, Antennas and Propagation Society International Symposium, 2002, 496-499, vol. 3.

(Continued)

*Primary Examiner*—Shih-Chao Chen
(74) *Attorney, Agent, or Firm*—Winstead PC

(57) ABSTRACT

The invention refers to a new type of multihole antenna which is mainly suitable for mobile communications or in general to any other application where the integration of telecom systems or applications in a single antenna is important. The antenna consists of a radiating element which at least includes one hole. By means of this configuration, the antenna provides a broadband and multiband performance, and hence it features a similar behaviour through different frequency bands. Also, the antenna features a smaller size with respect to other prior art antennas operating at the same frequency.

30 Claims, 10 Drawing Sheets

FOREIGN PATENT DOCUMENTS

| | | | |
|---|---|---|---|
| JP | 2131001 | | 5/1990 |
| JP | 3045530 | | 2/1991 |
| JP | 6338816 | | 12/1994 |
| JP | 9036651 | | 2/1997 |
| JP | 9270629 | | 10/1997 |
| JP | 10093331 | | 4/1998 |
| JP | 11150415 | | 6/1999 |
| JP | 2001094338 | | 4/2001 |
| WO | WO-01/22528 | | 3/2001 |
| WO | 0126182 | A1 | 4/2001 |
| WO | WO-01/54225 | | 7/2001 |
| WO | 0180354 | A1 | 10/2001 |
| WO | 0235652 | A1 | 5/2002 |
| WO | 02095869 | A1 | 11/2002 |
| WO | WO-03/034538 | | 4/2003 |
| WO | 03/041216 | A2 | 5/2003 |

OTHER PUBLICATIONS

Baliarda, Carles Puente, et al; "An Iterative Model for Fractal Antennas: Application to the Sierpinski Gasket Antenna", IEEE Transactions on Antennas and Propagation, vol. 48, No. 5 May 2000, pp. 713-719.

Puente-Baliarda, Carles; "On the Behavior of the Sierpinski Multiband Fractal Antenna", IEEE Transactions on Antennas and Propagation, vol. 46, No. 4, Apr. 1998, pp. 517-524.

Soler, J et al.; "Novel Broadband and Multiband Solutions for Planar Monopole Antennas", IEEE, 2002, p. 184.

Song, C. T. P. et al.; "Multi-circular Loop Monopole Antenna", Electronic Letters, Mar. 2, 2000, vol. 36, No. 5, 2 pages.

Puente, C. et al.; "Fractal Multiband Antenna Based on the Sierpinski Gasket", Electronic Letters, Jan. 4, 1996, vol. 32, No. 1, pp. 1-2.

Agrawall, Narayan Prasad et al., "New Wideband Monopole Antennas", IEEE, Antennas and Propagation Society International Symposium, 1997, vol. 1, pp. 248-251.

Cetiner, A packaged miniature antenna for wireless networking, International Symposium on Microelectronic International Microelectronics and Packaging Society (IMAPS), 2001.

Vrenon, T. Fractal antennas offer benefits, copied from Radio World, Sep. 1999.

Kwon, Y.B., An internal triple-band planar inverted-F antenna, IEEE Antennas and Wireless Propagation Letters, 2003, vol. 2.

Song, P., Novel antenna design for future mobile systems, University of Birmingham, May 2001.

Raman, S. et al, Single- and dual-polarized millimeter-wave slot-ring antennas, IEEE Transactions on Antennas and propagation, vol. 44, No. 11, Nov. 1996.

Navarro, Monica, "Diverse modifications applied to the Sierpinski antenna, a multi-band fractal antenna", Universitat Politecnica de Catalunya, Oct. 1997.

* cited by examiner

ANTENNA WITH ONE OR MORE HOLES

OBJECT OF THE INVENTION

The present invention relates to a novel multihole antenna which operates simultaneously at several frequencies with an improved impedance match. Also, the antenna features a smaller size with respect to other prior art antennas operating at the same frequency.

The radiating element of the novel multihole antenna consists of an antenna shaped by means of a polygonal, space-filling, loaded or multilevel shape, which at least includes one hole in the radiating antenna surface.

The invention refers to a new type of multihole antenna which is mainly suitable for mobile communications or in general to any other application where the integration of telecom systems or applications in a single antenna is important.

BACKGROUND OF THE INVENTION

The growth of the telecommunication sector, and in particular, the expansion of personal mobile communication systems are driving the engineering efforts to develop multiservice (multifrequency) and compact systems which require multifrequency and small antennas. Therefore, the use of a multisystem small antenna with a multiband and/or wideband performance, which provides coverage of the maximum number of services, is nowadays of notable interest since it permits telecom operators to reduce their costs and to minimize the environmental impact.

Most of the multiband reported antenna solutions use one or more radiators or branches for each band or service. An example is found in U.S. patent Ser. No. 09/129,176 entitled "Multiple band, multiple branch antenna for mobile phone".

One of the alternatives which can be of special interest when looking for antennas with a multiband and/or small size performance are multilevel antennas, Patent publication WO0122528 entitled "Multilevel Antennas", miniature space-filling antennas, Patent publication WO0154225 entitled "Space-filling miniature antennas", and loaded antennas, Patent application PCT/EP01/11914 entitled "Loaded Antenna".

N. P. Agrawall ("New wideband monopole antennas", Antennas and Propagation Society International Symposium, 1997, IEEE, vol. 1, pp. 248-251) presents the results for a set of solid planar polygonal monopole antennas, which are not the case of the present invention.

SUMMARY OF THE INVENTION

The key point of the invention is the shape of the radiating element which includes a set of holes practised in the radiating element. According to the present invention the antenna is a monopole or a dipole which includes at least one hole. Also, the antenna can include different holes with different shapes and sizes in a radiating element shaped by means of a polygonal, multilevel or loaded structure.

Due to the addition of the holes in the radiating element, the antenna can feature a multifrequency behaviour with a smaller size with respect to other prior art antennas operating at the same frequency. In typical embodiments, the radiating element is shorter than a quarter of the longest operating wavelength of the antenna. For the mentioned multifrequency behaviour, said hole in a monopole or dipole antenna features an area of at least a 20% of the area included inside the external perimeter of the radiating element of said antenna.

The novel monopole or dipole includes a radiating element of a conducting or superconducting material with at least one hole, wherein the hole can be filled with a dielectric or partially filled by a conducting or superconducting material different from the conductor used for the radiating element.

In the novel antenna, the holes, or a portion of them, can be shaped with a geometry chosen form the set: multilevel, loaded, space-filling or polygonal structures. These geometries being understood as described in the previously identified patents.

The main advantage of this novel multihole antenna is two-folded:

The antenna features a multifrequency behaviour

The antenna can be operated at a lower frequency than most of the prior art antennas

BRIEF DESCRIPTION OF THE DRAWINGS

FIG. 9 shows a multihole antenna. Case 25 shows a radiating element with a circular shape with two identical holes (25*a*) and with a third bigger hole (25*b*).

DETAILED DESCRIPTION OF SOME PREFERRED EMBODIMENTS

Figure 5:
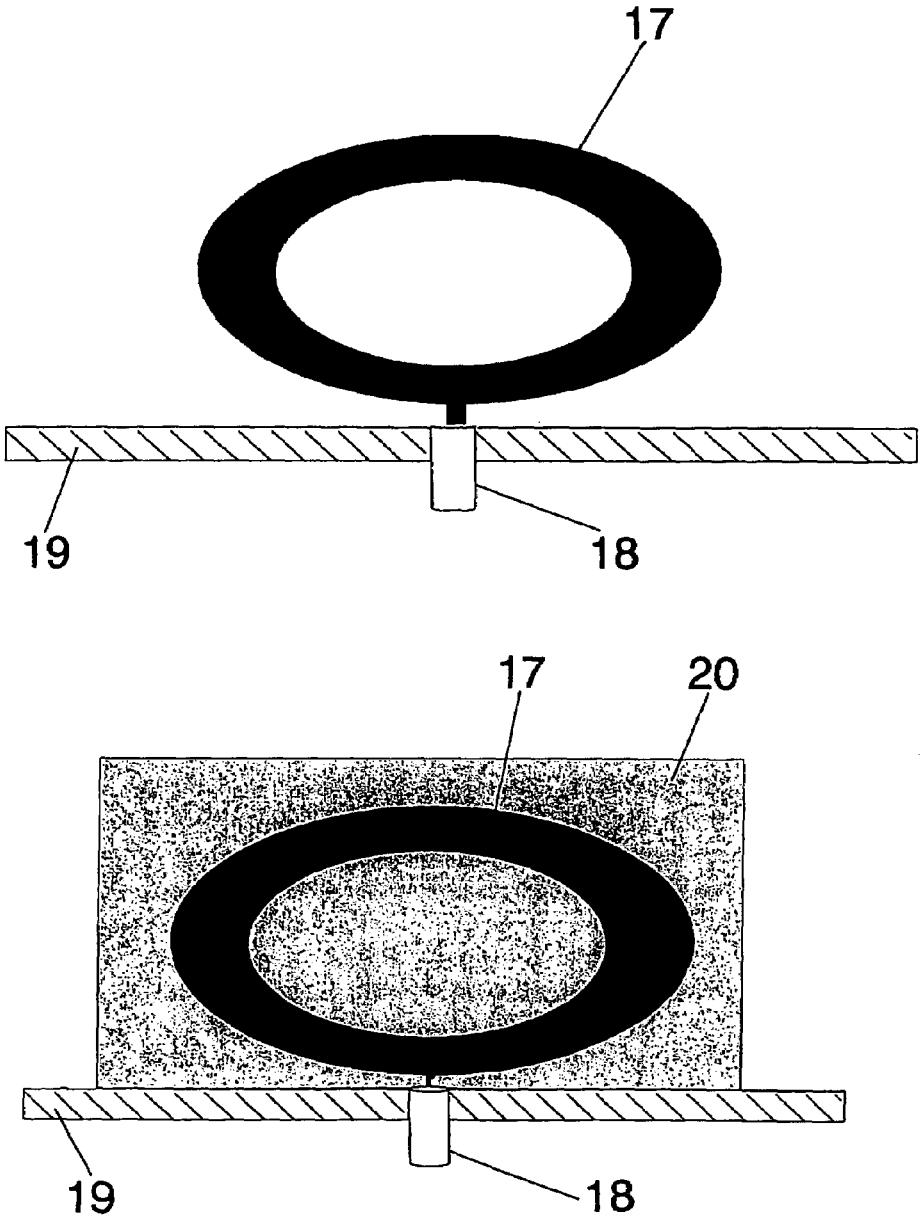
FIG. 5 shows two particular cases of multihole antenna. They consist of a monopole comprising a conducting or superconducting ground plane with an opening to allocate a coaxial cable (18) with its outer conductor connected to said ground plane and the inner conductor connected to the multihole radiating element (17). The radiating element (17) can be optionally placed over a supporting dielectric (20).

A preferred embodiment of the multihole antenna is a monopole configuration as shown in FIG. 5. A handheld telephone case, or even a part of the metallic structure of a car or train can act as such a ground counterpoise. The ground and the monopole arm (17) (here a particular embodiment of the arm is represented, but any of the mentioned multihole antenna structures could be taken instead) are excited as usual in prior art monopole by means of, for instance, a transmission line (18). Said transmission line is formed by two conductors, a first conductor is connected to a point of the conducting or superconducting multihole structure and the second conductor is connected to the ground plane or to a ground counterpoise. In FIG. 5, a coaxial cable (18) has been taken as a particular case of transmission line, but it is clear to any skilled in the art that other transmission lines (such as for instance a microstrip arm) could be used to excite the monopole. Optionally, and following the scheme just described, the multihole monopole can be printed, etched or attached, for instance, over a dielectric substrate (20).

Figure 1:
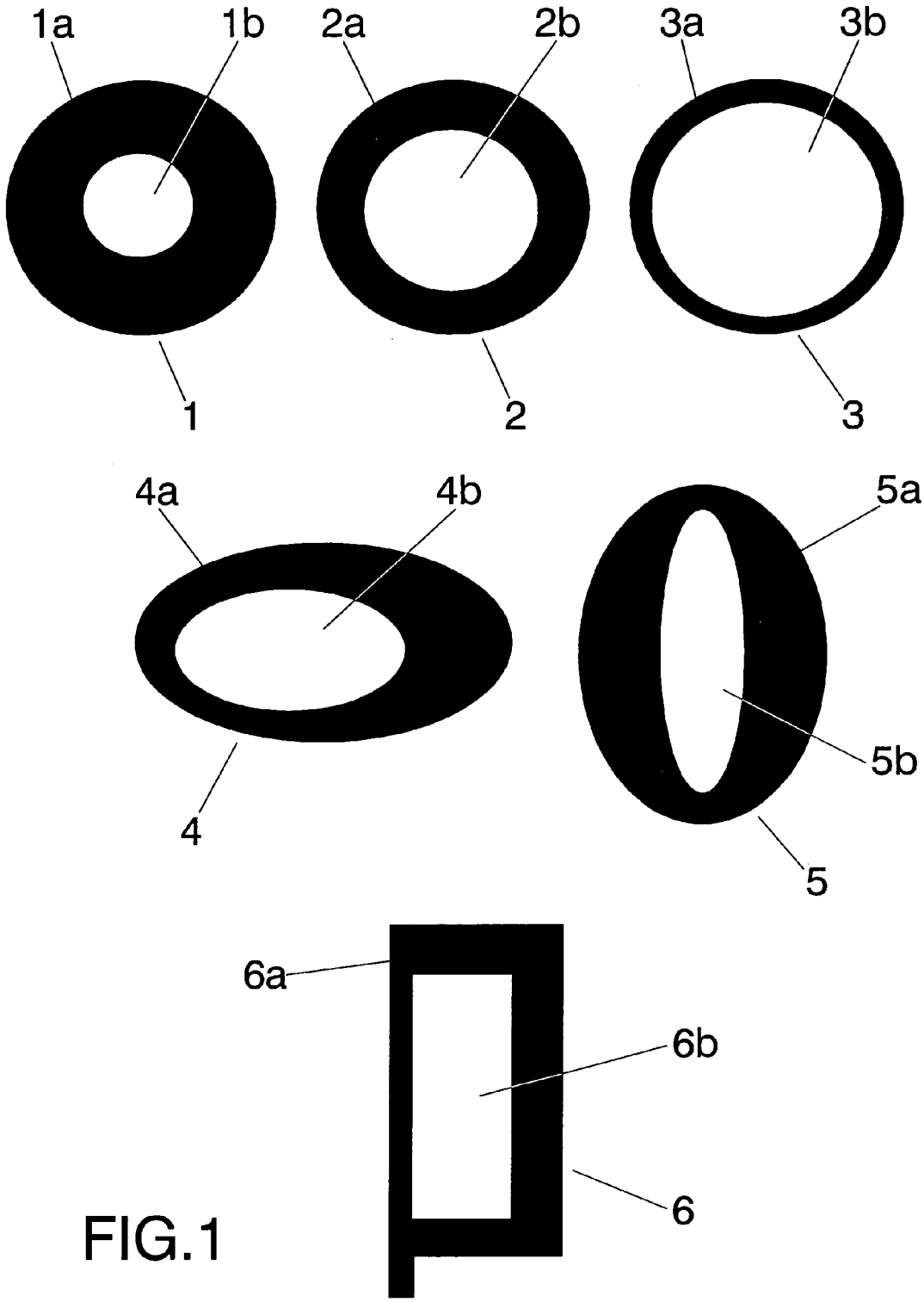
FIG. 1 shows three different antennas including one hole; those are, a circular, an elliptical and a rectangular antenna. All the cases are polygonal shapes, including the circles and the ellipses as they can be considered polygonal structures with a large number of sides. Cases 1 to 3 show an antenna where the radiating element (1*a*, 2*a*, 3*a*) is a circle including one hole (1*b*, 2*b*, 3*b*), wherein the size of the hole (1*b*, 2*b*, 3*b*) increases from cases 1 to 3, being the biggest one (3*b*) and the smallest one case (1*b*). Also, cases 1 to 3 includes a hole (1*b*, 2*b*, 3*b*) with a circular shape. Case 4 and 5 describe an elliptical monopole with an elliptical hole (4*b*, 5*b*). In case (4) the hole (4*b*) is not symmetrically located with respect to the vertical axis of the radiating element (4*a*). Case 6 shows a rectangular monopole including one rectangular hole (6*b*). In all cases in FIG. 1 the area of the hole (1*b*, 2*b*, 3*b*, 4*b*, 5*b*, 6*b*) is at least a 20% of the area included in the external perimeter of the radiating element (1*a*, 2*a*, 3*a*, 4*a*, 5*a*, 6*a*).
Figure 2:
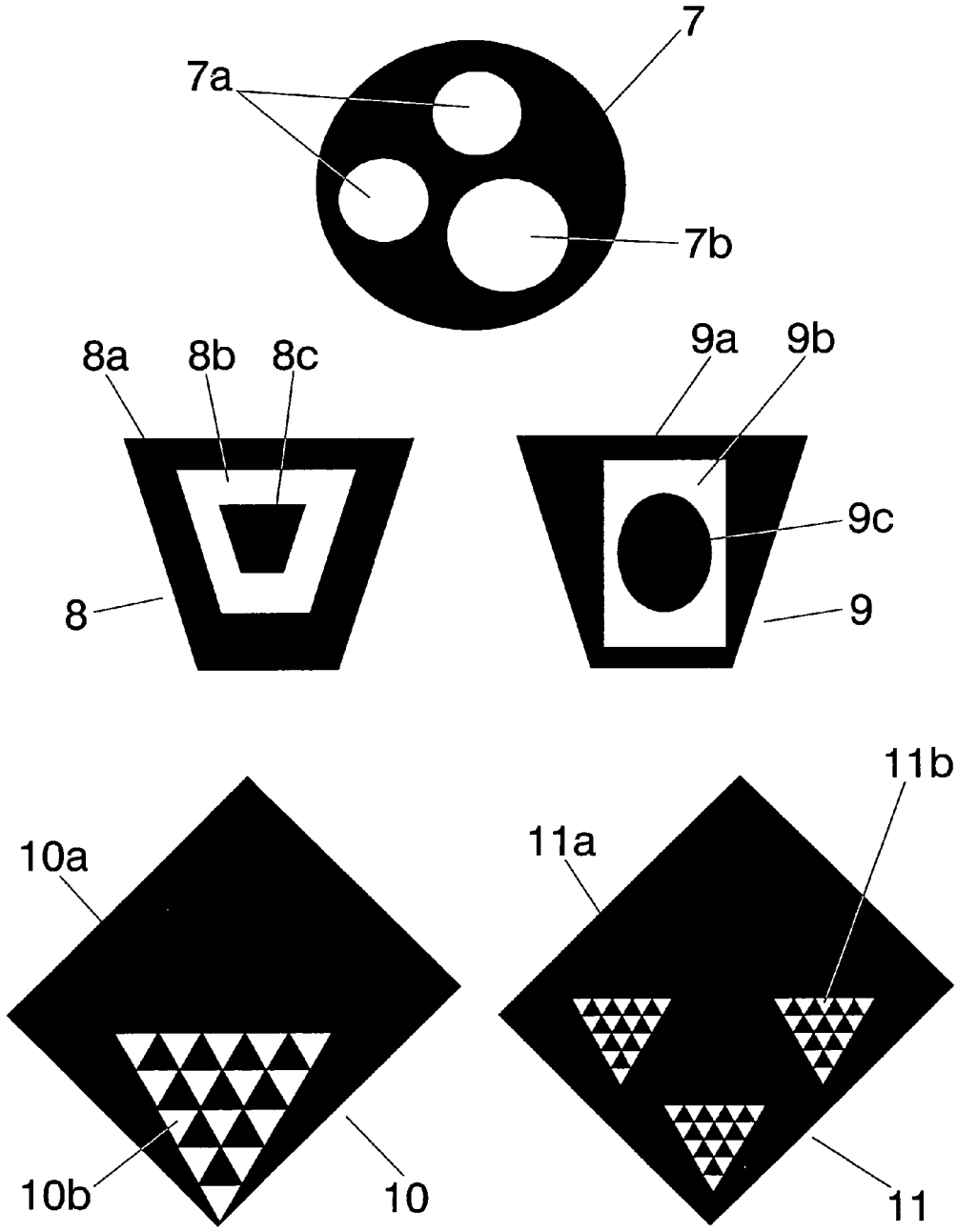
FIG. 2 shows three different types of multihole antenna. Case 7 shows a radiating element with a circular shape with two identical circular holes (7*a*) and with a third bigger hole (7*b*). The antennas in cases 8 and 9 are multihole antennas where the hole (8*b*, 9*b*) is shaped as a curve, said curve intersecting itself at a point. Cases 10 and 11 shows a polygonal radiating element (10*a*, 11*a*) with one (10*b*) and three holes (11*b*), respectively, shaped using a multilevel structure.
Figure 3:
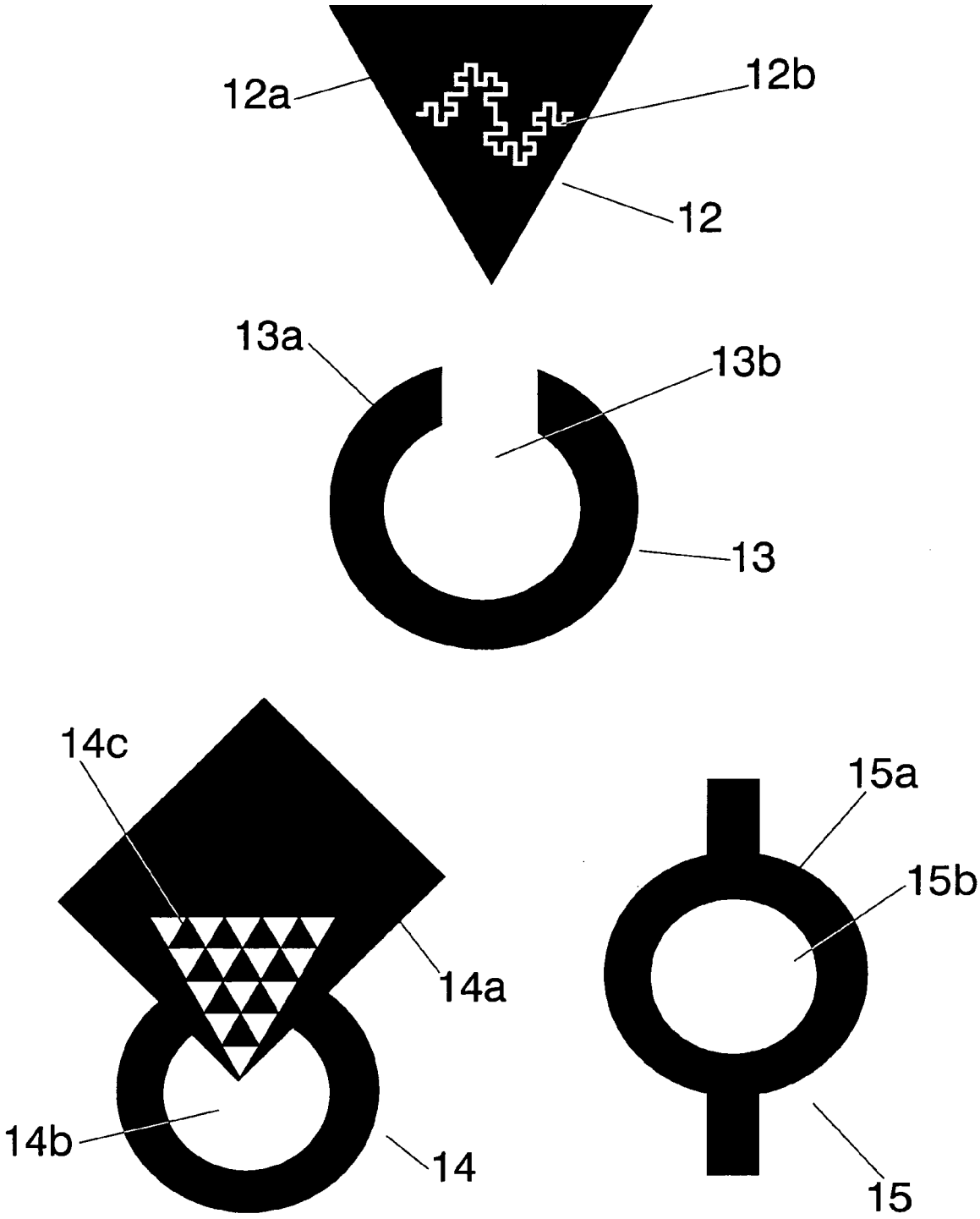
In FIG. 3, case 12 shows a radiating element with a triangular shape which includes one hole shaped by means of a space-filling curve (12*b*). Case 13 shows a multihole antenna with a circular hole, wherein the hole intersects the perimeter of the radiating element at a distance to the feeding point shorter than a quarter, or longer than three quarters, of the external perimeter of the radiating element. Case 14 describes a radiating element (14*a*) composed by a rectangular and a circular shape, which includes two holes; those are, a circular-shaped hole (14*b*) and a hole shaped by means a multilevel structure (14*c*). Case 15 shows another radiating element with a hole with a circular shape (15*b*).
Figure 4:
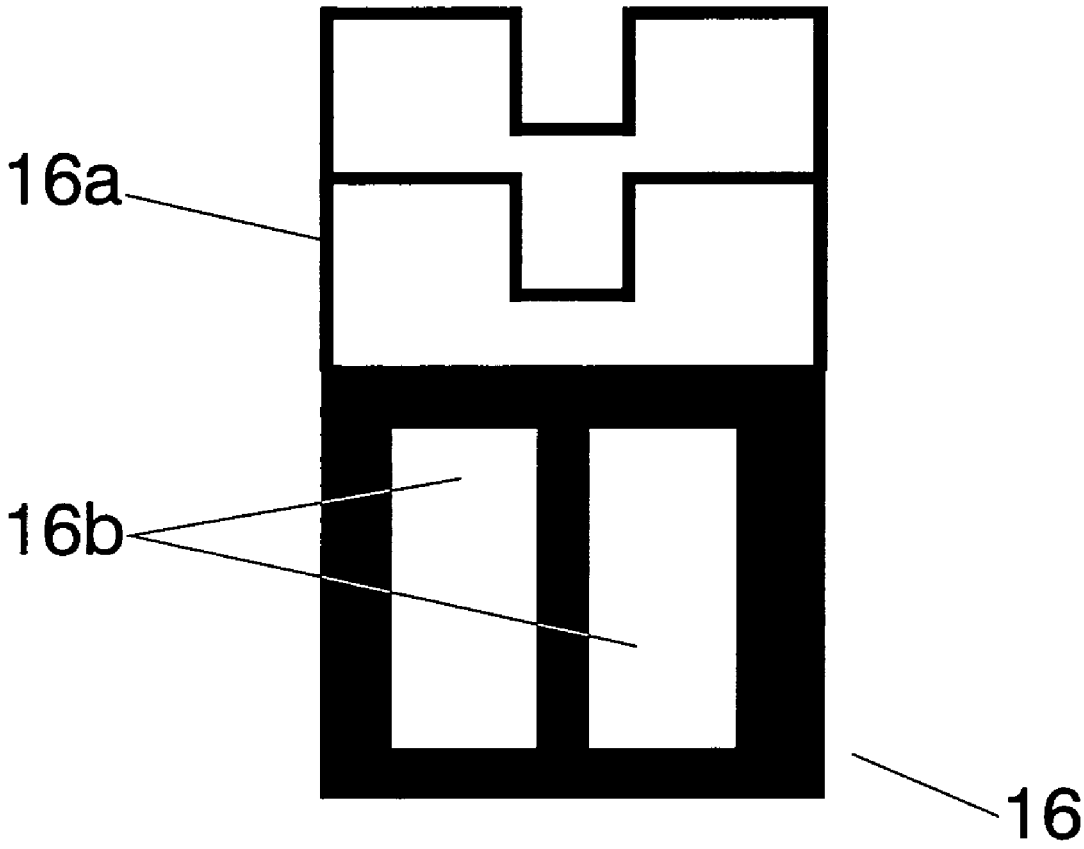
FIG. 4, case 16, shows a loaded radiating element (16*a*) including two rectangular holes (16*b*).
Figure 6:
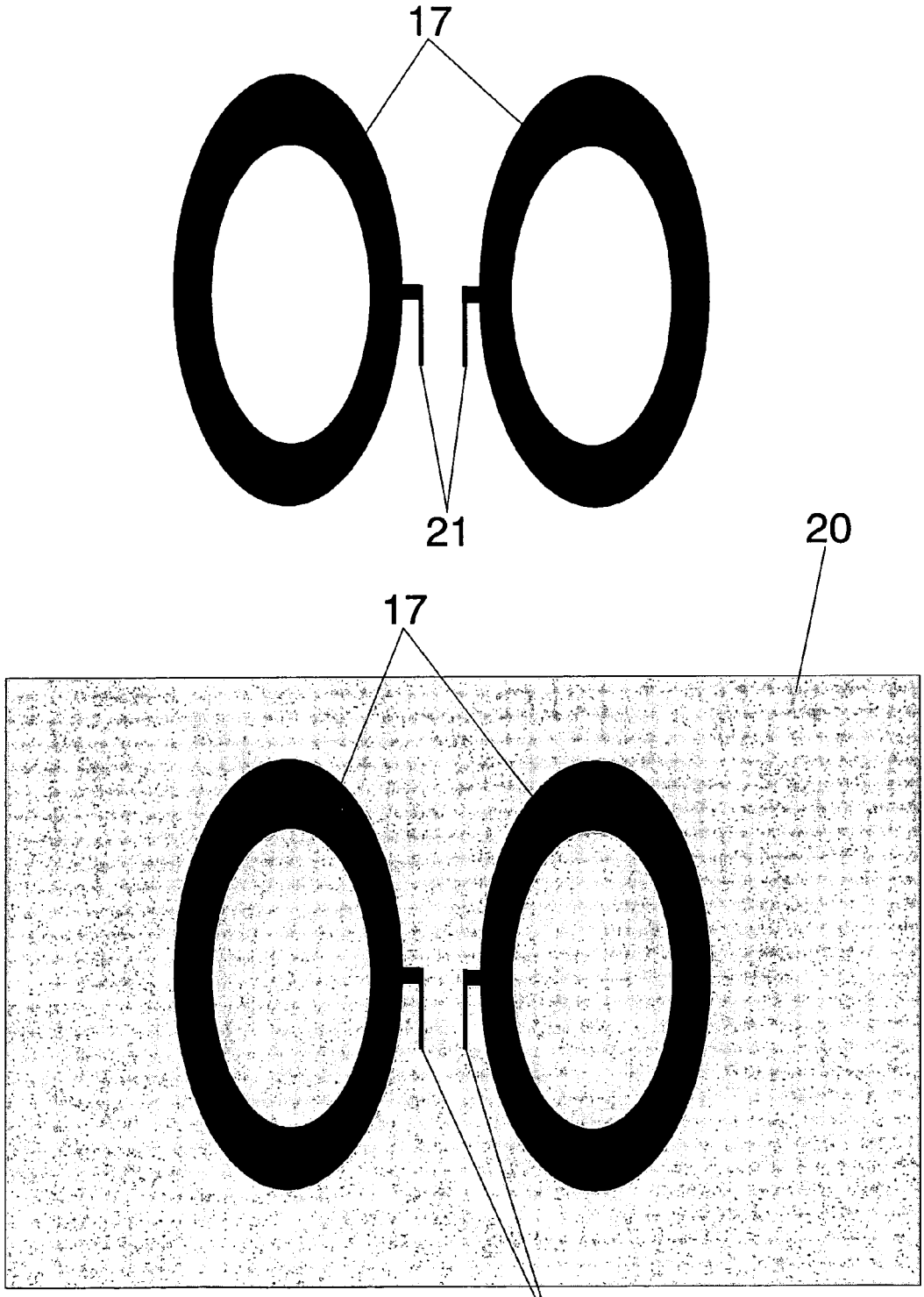
FIG. 6 shows a multihole antenna consisting of a dipole wherein each of the two arms includes one hole. The lines (21) indicate the input terminals points. The two drawings display different configurations of the same basic dipole; in the lower drawing the radiating element is supported by a dielectric substrate (20).

FIG. 6 describes another preferred embodiment of the invention. A two-arm antenna dipole is constructed comprising two conducting or superconducting parts, each part being a multihole structure. For the sake of clarity but without loss of generality, a particular case of the multihole antenna (17) has been chosen here; obviously, other structures, as for instance, those described in FIG. 1 could be used instead. In this particular case, two points (21) on the perimeter of each arm can are taken as the input part of the dipole structure. In other embodiments, other point can be takes as the input terminals. The terminals (21) have been drawn as conducting or superconducting wires, but as it is clear to those skilled in the art, such terminals could be shaped following any other pattern as long as they are kept small in terms of the operating wavelength. The skilled in the art will notice that, the arms of the dipoles can be rotated and folded in different ways to finely modify the input impedance or the radiation properties of the antenna, such as, for instance, polarization.

Another preferred embodiment of a multihole dipole antenna is also shown in FIG. 6 where the multihole arms are printed over a dielectric substrate (20); this method is particularly convenient in terms of cost and mechanical robustness when the shape of the radiating element contains a high number of polygons, as happens with multilevel structures. Any of the well-known printed circuit fabrication techniques can be applied to pattern the multihole antenna structure over the dielectric substrate. Said dielectric substrate can be, for instance, a glass-fibre board, a teflon based substrate (such as Cuclad.RTM.) or other standard radiofrequency and microwave substrates (as for instance Rogers 4003.RTM. or Kapton.RTM.). The dielectric substrate can be, for instance, a portion of a window glass if the antenna is to be mounted in a motor vehicle such as a car, a train or an airplane, to transmit or receive radio, TV, cellular telephone (GSM900, GSM1800, UMTS) or other communication services electromagnetic waves. Of course, a balun network can be connected or integrated in the input terminals of the dipole to balance the current distribution among the two dipole arms.

Figure 7:
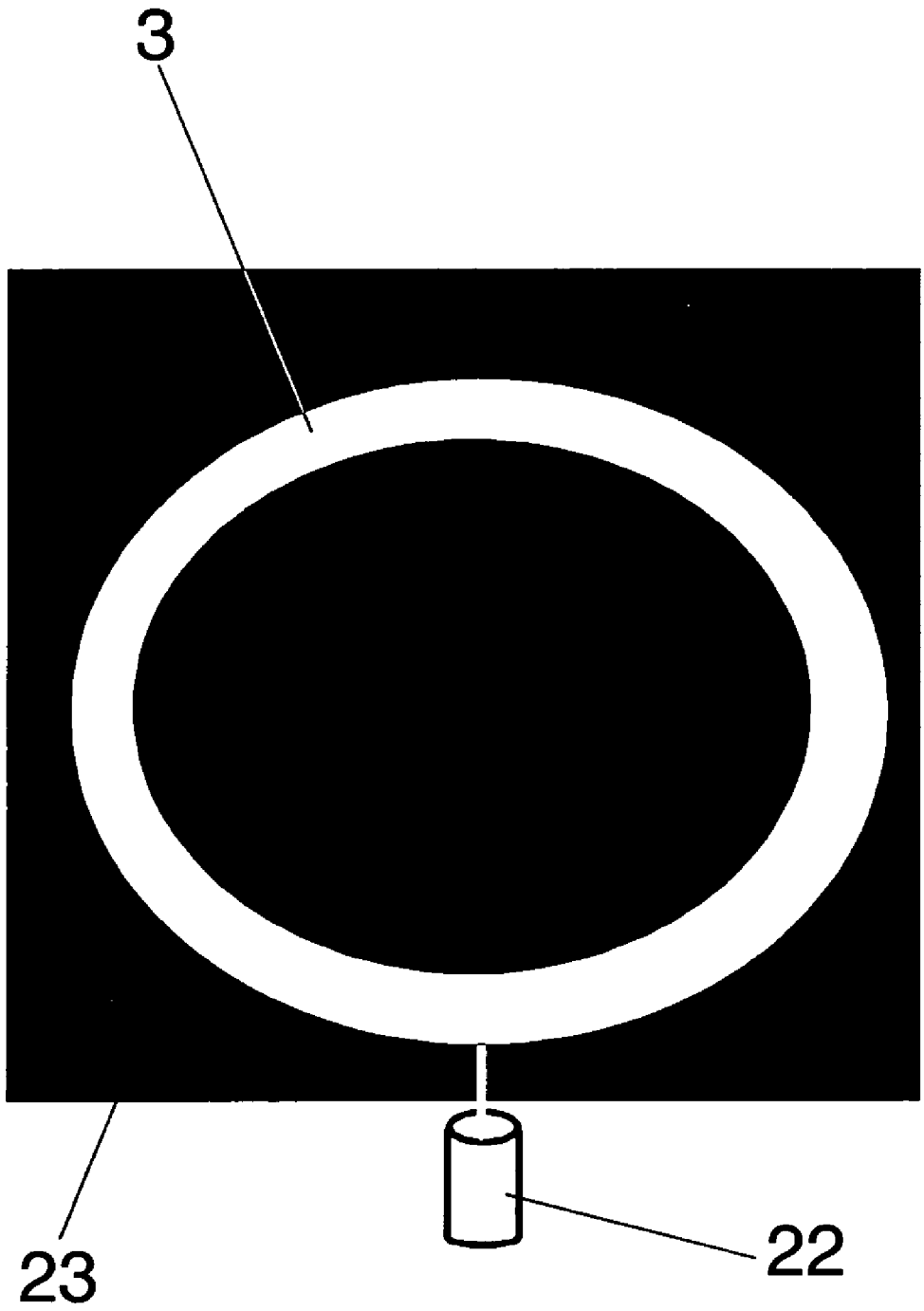
FIG. 7 shows an aperture antenna, wherein a multihole structure is practiced as an aperture antenna (3). The aperture is practiced on a conducting or superconducting structure (23).

Another preferred embodiment of the multihole antenna is an aperture configuration as shown in FIG. 7. In this figure the multihole elliptical structure (3) forms a slot or gap impressed over a conducting or superconducting sheet (23). Such sheet can be, for instance, a sheet over a dielectric substrate in a printed circuit board configuration, a transparent conductive film such as those deposited over a glass window to protect the interior of a car from heating infrared radiation, or can even be apart of the metallic structure of a handheld telephone, a car, train, boat or airplane. The feeding scheme can be any of the well known in conventional slot antenna and it does not become an essential part of the present invention. In the illustration in FIG. 7, a coaxial cable (22) has been used to feed the antenna, with one of the conductors connected to one side of the conducting sheet and the other connected at the other side of the sheet across the slot. A microstrip line could be used, for instance, instead of a coaxial cable.

Figure 8:
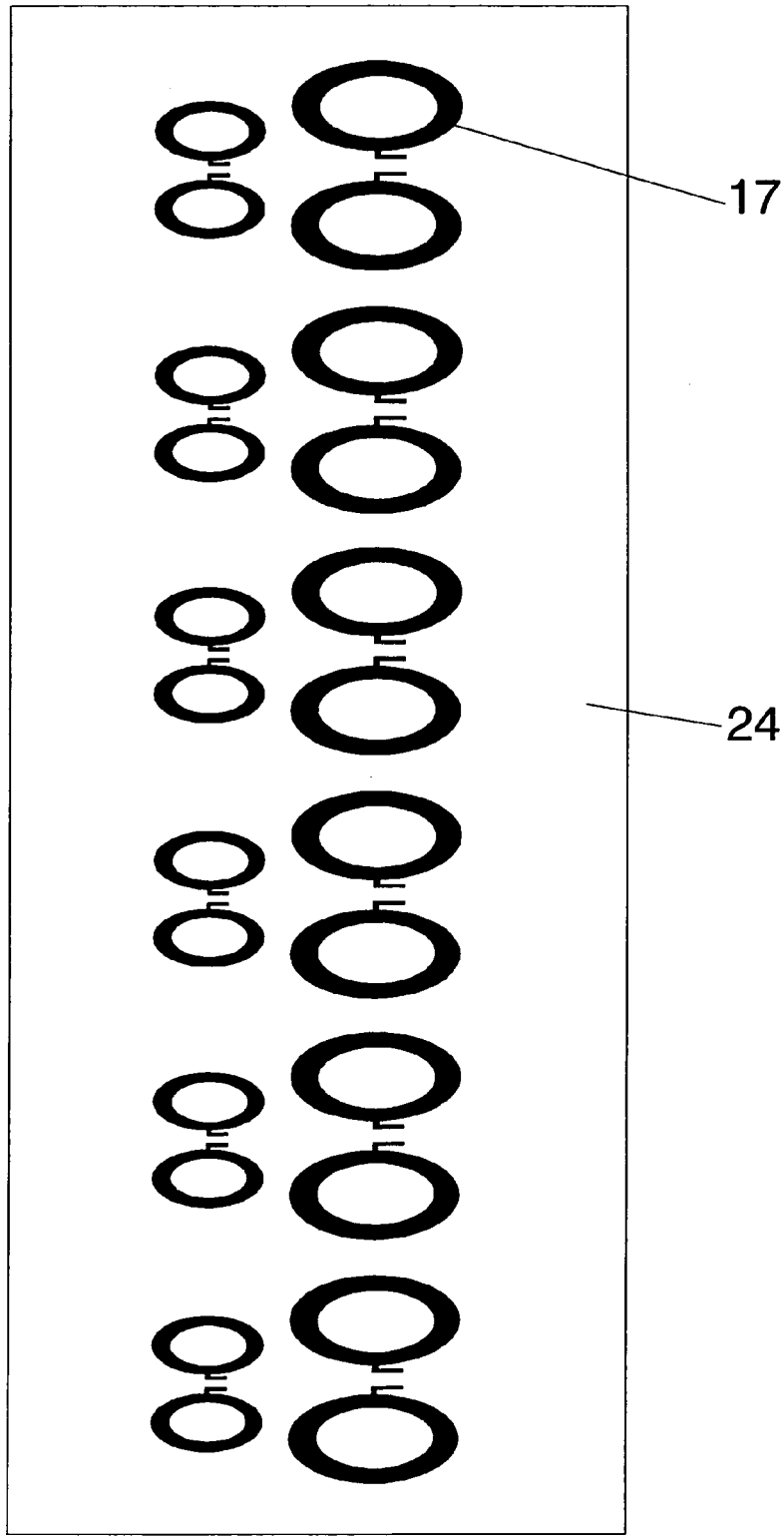
FIG. 8 shows an antenna array (24) including multihole radiating elements (17).
Figure 9:
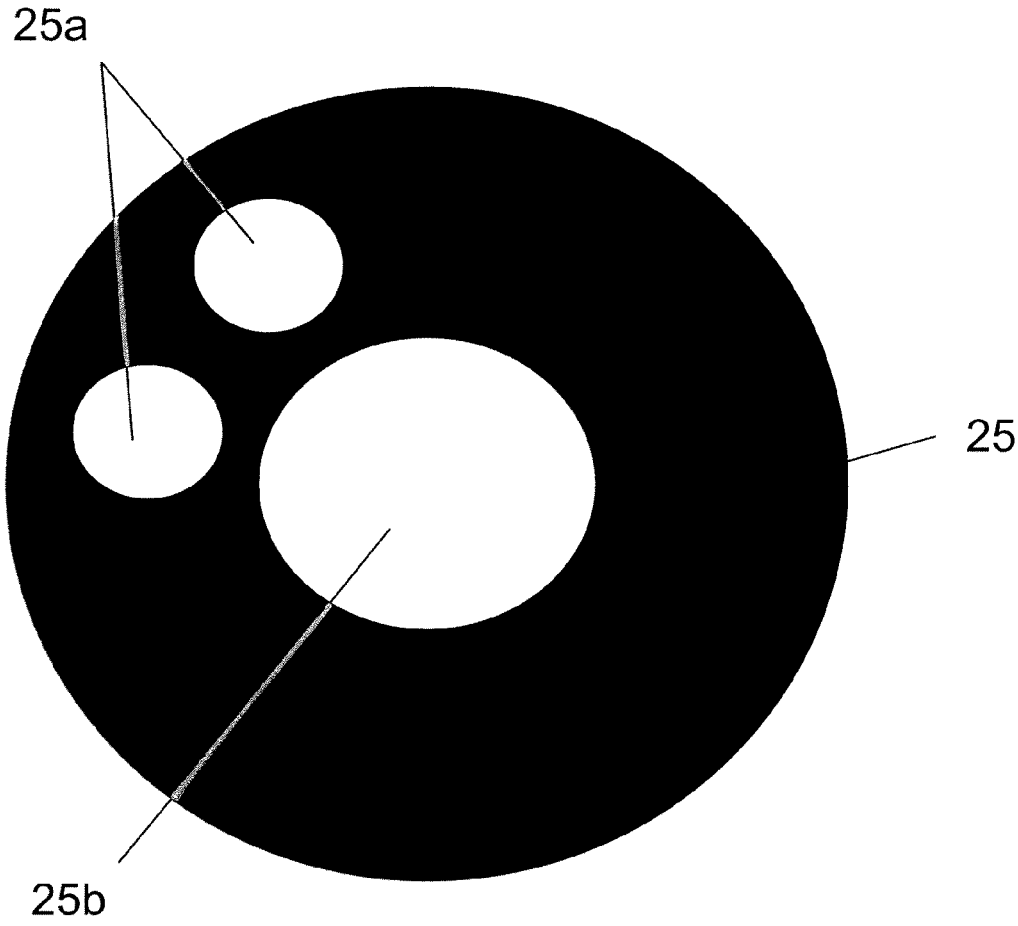
FIG. 9 shows an antenna in which the perimeter of a hole formed therein is shaped with a hexagonal geometry.
Figure 10:
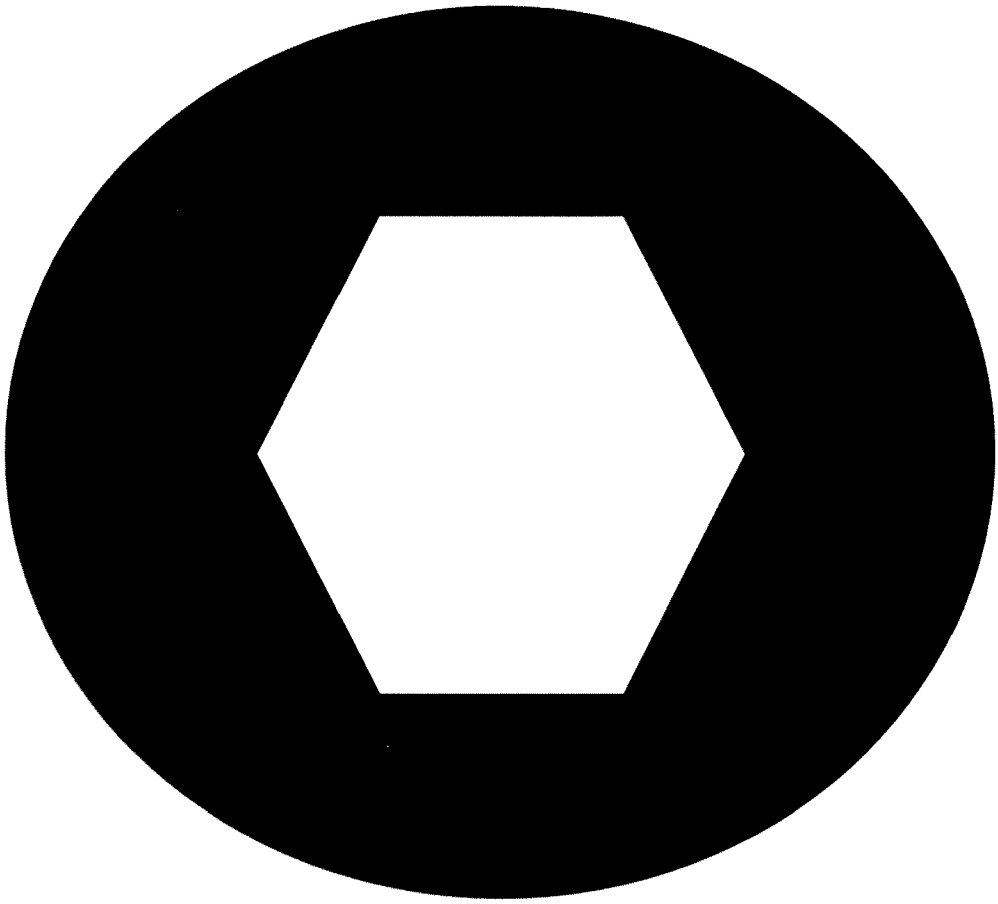
FIG. 10 shows an antenna, having a circular radiating element, in which the perimeter of a hole formed therein is shaped with a hexagonal geometry.

FIG. 8 describes another preferred embodiment. It consist of an antenna array (24) which includes at least one multihole dipole antenna (17).

The invention claimed is:

1. A monopole antenna comprising:

a radiating element defining an external perimeter;

wherein the radiating element comprises at least one hole;

wherein the at least one hole has an area of at least 20% of an area included inside the external perimeter;

wherein the external perimeter of the radiating element is shaped as a polygonal element comprising at least four sides;

wherein a perimeter of the at least one hole is shaped as a polygon comprising three or more sides;

wherein the radiating element is shorter than a quarter of a longest operating wavelength of the monopole antenna;

wherein the monopole antenna features a multiband behavior;

wherein the external perimeter of the radiating element and the perimeter of at least one of the at least one hole are not both circles; and wherein the external perimeter of the radiating element and the perimeter of at least one of the at least one hole are not both ellipses.

2. The antenna according to claim 1, wherein the radiating element is a conducting or superconducting body, the body including at least one hole which is filled with a dielectric material.

3. The antenna according to claim 1, wherein the radiating element is a conducting or superconducting body, the body including at least one hole which is partially filled by a conducting or superconducting material.

4. The antenna according to claim 1, wherein the perimeter of the radiating element is shaped with a geometry selected from the group: square, rectangular, circular or elliptical.

5. The antenna according to claim 1, wherein the perimeter of the at least one hole is shaped with a geometry selected from the group: triangular, square, rectangular, circular or elliptical.

6. The antenna according to claim 1, wherein the perimeter of the radiating element is circular and the perimeter of the at least one hole is hexagonal.

7. The antenna according to claim 1, wherein the external perimeter of the radiating element comprises at least two more sides than the perimeter of the at least one hole with the least number of sides.

8. The antenna according to claim 1, wherein the external perimeter of the radiating element or the perimeter of the at least one hole comprises five or more sides.

9. The antenna according to claim 1, wherein the at least one hole is not symmetrically aligned with respect to a vertical axis of the radiating element.

10. The antenna according to claim 1, wherein a portion of the antenna is a multilevel structure.

11. The antenna according to claim 10, wherein at least a portion of the at least one hole is a multilevel structure.

12. The antenna according to claim 1, wherein a portion of the antenna is a loading structure.

13. The antenna according to claim 1, wherein the radiating element comprises at least two holes and wherein the at least two holes are not similar in shape.

14. The antenna according to claim 13, wherein the antenna has a polygonal perimeter with more than four sides, a first larger hole symmetrically placed in the center of the perimeter, and a set of smaller holes with the same area radially arranged around said first larger hole.

15. The antenna according to claim 1, wherein the radiating element comprises at least two holes and wherein the at least two holes are not similar in size.

16. The antenna according to claim 1, wherein the perimeter of the at least one hole is a curve comprising a minimum of two segments and a maximum of nine segments connected in such a way that each segment forms an angle with their neighbors such that no pair of adjacent segments define a larger straight segment.

17. The antenna according to claim 1, wherein the perimeter of the at least one hole is shaped by means of a space-filling curve.

18. The antenna according to claim 1, wherein the at least one hole intersects the perimeter of the radiating element at a distance to its feeding point shorter than a quarter, or longer than three quarters, of the external perimeter of the radiating element.

19. The antenna according to claim 1, wherein the at least one hole is shaped as a curve, the curve intersecting itself at least at one point.

20. The antenna according to claim 1, wherein the antenna features a broadband behavior.

21. The antenna according to claim 1, wherein at least one of the operating bands of the antenna is broadband.

22. The antenna according to claim 1, wherein the radiating element is printed, etched or attached over a dielectric substrate.

23. The antenna according to claim 22, wherein the dielectric substrate is part of a structure selected from the group: a window glass of a motor vehicle, a metallic structure of a motor vehicle, a structure of a handheld terminal.

24. The antenna according to claim 22, wherein the at least one hole intersects the perimeter of the radiating element at a distance to its feeding point shorter than a quarter, or longer than three quarters, of the external perimeter of the radiating element.

25. The antenna according to claim 1, wherein the antenna is used to transmit or receive electromagnetic waves for at least one of the following telecom systems: GSM900, GSM1800, UMTS.

26. The antenna according to claim 1, wherein the antenna is used to transmit or receive electromagnetic waves simultaneously for at least one of the following telecom systems: GSM900, GSM1800, UMTS.

27. A handheld telephone comprising:

a monopole antenna comprising:

a radiating element defining an external perimeter;

wherein the radiating element comprises at least one hole;

wherein the at least one hole has an area of at least 20% of an area included inside the external perimeter;

wherein the external perimeter of the radiating element is shaped as a polygonal element comprising at least four sides;

wherein a perimeter of the at least one hole is shaped as a polygon comprising three or more sides;

wherein the radiating element is shorter than a quarter of a longest operating wavelength of the monopole antenna;

wherein the monopole antenna features a multiband behavior;

wherein the external perimeter of the radiating element and the perimeter of at least one of the at least one hole are not both circles; and wherein the external perimeter of the radiating element and the perimeter of at least one of the at least one hole are not both ellipses.

28. The antenna according to claim 27, wherein the at least one hole intersects the perimeter of the radiating element at a distance to its feeding point shorter than a quarter, or longer than three quarters, of the external perimeter of the radiating element.

29. A monopole antenna comprising:

a radiating element defining an external perimeter;

wherein the radiating element comprises at least one hole;

wherein the at least one hole has an area of at least 20% of an area included inside the external perimeter;

wherein the external perimeter of the radiating element is shaped as a polygonal element comprising at least four sides;

wherein the perimeter of the at least one hole is shaped as a polygon comprising three or more sides;

wherein the radiating element is shorter than a quarter of a longest operating wavelength of the antenna;

wherein the monopole antenna features a multiband behavior; and wherein the at least one hole is not symmetrically aligned with respect to a vertical axis of the radiating element.

30. A monopole antenna comprising:

a radiating element defining an external perimeter;

wherein the radiating element comprises at least one hole;

wherein the at least one hole has an area of at least 20% of an area included inside the external perimeter;

wherein the external perimeter of the radiating element is shaped as a polygonal element comprising at least four sides;

wherein the perimeter of the at least one hole is shaped as a polygon comprising three or more sides;

wherein the radiating element is shorter than a quarter of a longest operating wavelength of the antenna;

wherein the monopole antenna features a multiband behavior; and wherein the radiating element comprises at least two holes and wherein the at least two holes are not similar in shape.

* * * * *